US009478089B2

(12) United States Patent
Izawa et al.

(10) Patent No.: US 9,478,089 B2
(45) Date of Patent: Oct. 25, 2016

(54) SYSTEM FOR HANDLING VALUABLE DOCUMENTS

(75) Inventors: Hikaru Izawa, Tokyo (JP); Yasumasa Suzuki, Tokyo (JP); Nobuo Takashima, Tokyo (JP)

(73) Assignee: Japan Cash Machine, Co. Ltd., Osaka (JP)

( * ) Notice: Subject to any disclaimer, the term of this patent is extended or adjusted under 35 U.S.C. 154(b) by 544 days.

(21) Appl. No.: 12/988,006

(22) PCT Filed: Apr. 10, 2009

(86) PCT No.: PCT/JP2009/001678

§ 371 (c)(1),
(2), (4) Date: Dec. 28, 2010

(87) PCT Pub. No.: WO2009/128234

PCT Pub. Date: Oct. 22, 2009

(65) Prior Publication Data

US 2012/0086972 A1 Apr. 12, 2012

(30) Foreign Application Priority Data

Apr. 16, 2008 (JP) ..... 2008-107312

(51) Int. Cl.
*G07D 7/00* (2016.01)
*B41J 29/36* (2006.01)
*G07F 17/42* (2006.01)

(52) U.S. Cl.
CPC ..... *G07D 7/00* (2013.01); *B41J 29/36* (2013.01); *G07F 17/42* (2013.01)

(58) Field of Classification Search
None
See application file for complete search history.

(56) References Cited

U.S. PATENT DOCUMENTS

| | | | | |
|---|---|---|---|---|
| 5,420,406 | A | 5/1995 | Izawa et al. | |
| 6,585,260 | B1 | 7/2003 | Izawa et al. | |
| 6,993,758 | B1 | 1/2006 | Fujita et al. | |
| 2005/0059482 | A1 * | 3/2005 | Hedrick et al. | 463/29 |
| 2006/0068897 | A1 * | 3/2006 | Sanford et al. | 463/25 |
| 2008/0262971 | A1 * | 10/2008 | Davis et al. | 705/75 |

FOREIGN PATENT DOCUMENTS

| | | | |
|---|---|---|---|
| JP | 62-169267 | A | 7/1987 |
| JP | 3-276285 | A | 12/1991 |
| JP | 4-250185 | A | 9/1992 |
| JP | 4-302394 | A | 10/1992 |
| JP | 5-146555 | A | 6/1993 |
| JP | 6-150114 | A | 5/1994 |
| JP | 08293053 | * | 11/1996 |
| JP | 9-147189 | A | 6/1997 |
| JP | 11-353517 | A | 12/1999 |
| JP | 2001-101477 | A | 4/2001 |
| JP | 3320806 | B2 | 9/2002 |

* cited by examiner

*Primary Examiner* — Fan Zhang
(74) *Attorney, Agent, or Firm* — Bachman & LaPointe, PC

(57) ABSTRACT

A system for handling valuable documents is provided that comprises a validator 2 for validating authenticity of a valuable document, and a printer 3 for printing on a card 20 information in validator 2 and an interface 4 for connecting validator 2 and printer 3 for their intercommunication. Automatically or after a certain period of time, validator 2 transmits its stored validation information to printer 3 through interface 4. Otherwise, receiving a transmission instruction signal of validation information given upon turning a trigger switch on or receiving a retrieval instruction signal from printer 3, validator 2 transmits its stored validation information to printer 3 through interface 4 to print the validation information on card 20.

11 Claims, 7 Drawing Sheets

SYSTEM FOR HANDLING VALUABLE DOCUMENTS

TECHNICAL FIELD

This invention relates to a system for handling valuable documents that comprises a validator for validating authenticity of valuable documents and a printer for recording information on a card for intercommunication between the validator and printer.

BACKGROUND OF THE INVENTION

Patent Document 1 below shows a document stacker with an observation window for visibly confirming a kind or denomination of the stacked document in a safe and easy way. This document stacker is advantageous because it allows a person to visually confirm a kind of an uppermost document stacked in a stacker through a transparent member secured to a part of a frame in the stacker from outside of the frame without unlocking a lock device provided. A pushing plate for urging documents into a compartment in the stacker has its length and width both shorter than those of the document to show a periphery of the top document exposed out of the circumference of the pushing plate in contact with the top bill within the compartment. The document stacker also comprises a rod inserted from outside through a hole formed in the frame or a handle protruded from the pushing plate or a backing plate outside the frame through the hole to manually move the uppermost document to the position for visually confirming the document through the transparent member.

PRIOR ART DOCUMENTS

Patent Documents

[Patent Document 1] Japanese Patent Disclosure No. 2001-101477

FIG. 7 illustrates a prior art system for handling valuable documents that comprises a validator 200 and a printer 300 individually connected to a gaming machine 400. A bill 201 is inserted into (cashed in) validator 200 that then validates authenticity of bill 201, and when it decides bill 201 as genuine, validator 200 forwards an enabling signal to gaming machine 400 to cause a player to enjoy gaming machine 400. After terminating use of gaming machine 400, it issues (ticket-out) a coupon ticket 301 from printer 300 that prints a game credit on coupon ticket 301 for reinsertion (ticket-in) into validator 200. When validator 200 decides inserted coupon ticket 301 as genuine, the player can enjoy gaming machine 400 in accordance with the game credit recorded. Gaming machine 400 is connected to a host computer 500 for controlling a plurality of gaming machines.

FIG. 8 illustrates another example of prior art systems for handling valuable documents that likewise comprises a validator 200 and a printer 300 each connected to a gaming machine 400. When a bill 201 is inserted into validator 200, it validates authenticity of bill 201, and when decides it as genuine, validator 200 forwards an enabling signal to gaming machine 400 to cause a player to use gaming machine 400. Validator 200 shown in FIG. 8 cannot validate authenticity of coupon tickets. After using gaming machine 400, a player pushes a stop switch not shown to quit gaming, and then gaming machine 400 issues (ticket-out) a card 302 through a printer 300. At this time, a game credit by gaming is printed on issued card 302 that can then be reinserted (ticket-in) into printer 300. When printer 300 judges reinserted card 302 as genuine, printer 300 transmits game credit and other information recorded on card 302 to gaming machine 400 so that a player can utilize gaming machine 400 in accordance with the game credit.

Problem to be Solved by the Invention

The document stacker shown in Patent Document 1 is beneficial because it allows a person to visually confirm a kind of the document in stacker without unlocking a cover in the stacker, however, it is still disadvantageous because it requires troublesome and time-consuming operations comprising; firstly unlocking a door in a cabinet for accommodating the stacker and opening the door; secondly removing the stacker out of the cabinet; and thirdly lowering the pushing plate to visually confirm the uppermost document.

An object of the present invention is to provide a system for handling valuable documents capable of printing information stored in a validator on a card for visual confirmation of the information. Another object of the present invention is to provide a system for handling valuable documents that comprises a validator for validating authenticity of valuable documents and a printer for printing information on cards in an intercommunicated relationship between the validator and printer to access information stored in the validator from the printer. Still another object of the present invention is to provide a system for handling valuable documents that comprises a validator and a printer wherein the printer may detect instruction signals or operational program recorded on a card and forward them to the validator and also wherein the validator may retrieve validation information stored in a memory device so that the printer may print it on a card and the validator may update or change operational program installed in the validator.

SUMMARY OF THE INVENTION

The system for handling valuable documents according to the present invention, comprises a validator (2) for validating authenticity of valuable documents, a printer (3) for printing information on a card (20), and an interface (4) for bi-directionally intercommunicating validator (2) and printer (3). Validator (2) transmits its stored validation information to printer (3) through interface (4) automatically. Otherwise, receiving a transmission instruction signal of validation information given upon turning a trigger switch on or receiving a retrieval instruction signal from printer (3), validator (2) may transmit its stored validation information to printer (3) through interface (4) to print the validation information on card (20).

Effect of Invention

The system for handling valuable documents can bi-directionally intercommunicate the validator and printer to cause the printer to print validation information stored in the validator for visual confirmation of the validation information. Also, when a card is inserted into the printer, it may read out information recorded on the card and update or change operational program in the validator and to visually confirm the changed information of the operational program.

BEST MODE FOR CARRYING OUT THE INVENTION

With reference to FIGS. 1 to 6, embodiments will be described hereinafter of the system for handling valuable documents according to the present invention.

Figure 1:
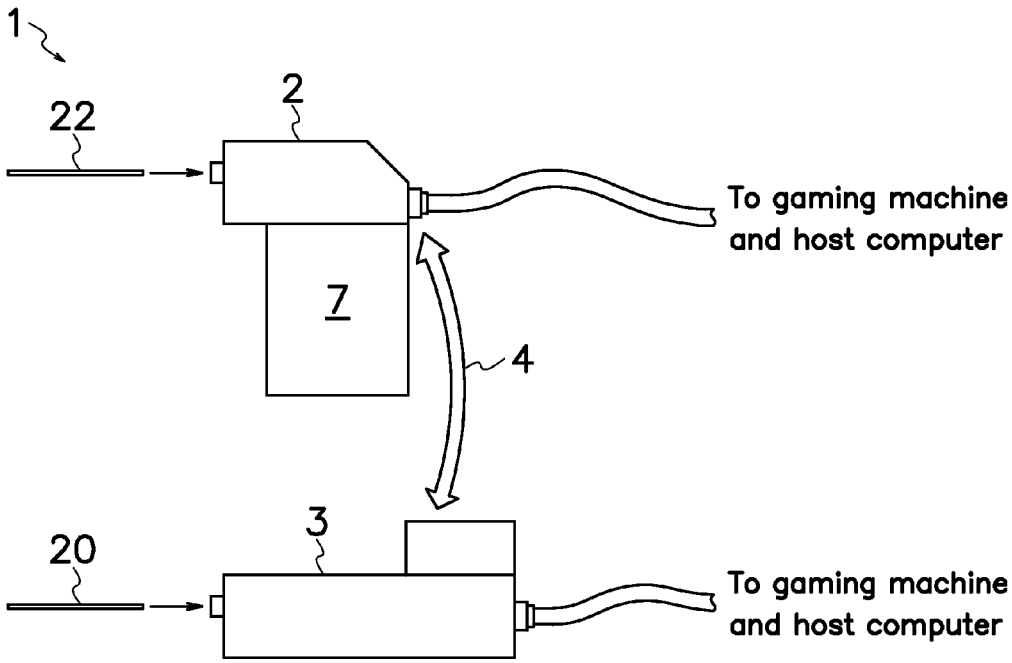
FIG. 1 A block diagram showing a profile of the system for handling valuable documents according to the present invention.

As shown in FIG. 1, the system 1 for handling valuable documents according to the present invention comprises a validator 2 for validating authenticity of valuable documents such as bills and/or coupon tickets, and a printer 3 for printing information on a card 20. Provided to bi-directionally intercommunicate validator 2 and printer 3 each other is an interface 4 that may comprise communication means such as wiring, or wireless connection including optical, electromagnetic or radio links for allowing mutual communication between validator 2 and printer 3. Validator 2 and printer 3 comprise respectively validator and printer transceivers 10 and 14 that each comprise communication protocol and connection interface allowing mutual communication therebetween. Not shown in the drawings, however, validator 2 and printer 3 each are connected to a host computer in a same gaming machine. Card 20 has magnetic information magnetically recorded on card 20 as retrieval instruction signals indicative of validation control instruction signals, validation diagnostic instruction signals, modified program information, game credit information, recording information, control number of the recording information or any combination thereof. Card 20 also has visible information thermally and erasably recorded on card 20 indicative of game credit information and card number.

Figure 2:
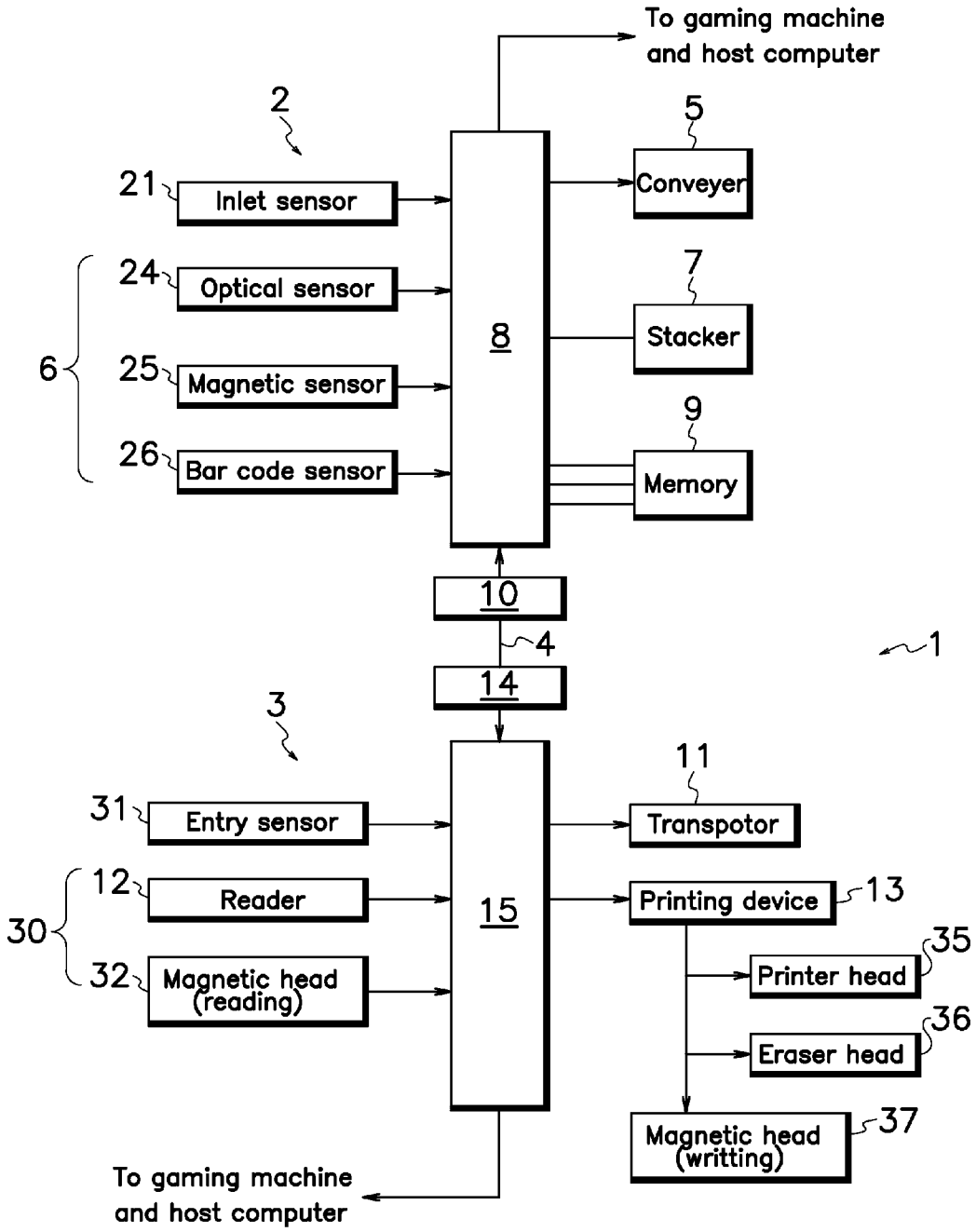
FIG. 2 An electric circuit diagram of the system for handling valuable documents according to the present invention.

As seen in FIG. 2, validator 2 comprises an inlet sensor 21 for detecting insertion of document 22 into an inlet of validator 2, a conveyor 5 for conveying document 22 along a passageway in validator 2, a discrimination sensor device 6 for detecting physical features of document 22 moved along the passageway to produce detection signals, a validator transceiver 10 for sending and receiving signals to and from printer 3, and a validation control device 8 having input terminals connected to inlet sensor 21 and discrimination sensor device 6 and an output terminal connected to conveyor 5. Discrimination sensor device 6 comprises an optical sensor 24 such as photo-coupler for converting optical features of document into electric signals, a magnetic sensor 25 such as magnetic head for converting magnetic features of document into electric signals, and a bar code sensor 26 for converting bar codes printed on document or a coupon ticket into electric signals. Validation control device 8 is connected to a memory device 9 for intercommunication between validation control device 8 and memory device 9 so that validation control device 8 may process validation information of valuable documents and write or store processed validation information in memory device 9, search validation information written in memory device 9 and selectively or totally retrieve specific or all validation information from memory device 9. Validation control device 8 also is connected to validator transceiver 10 for mutual communication and has means for confirming reception of a retrieval instruction signal to decide on whether or not validator transceiver 10 receives a retrieval instruction signal from printer 3. When the means for confirming confirms receipt of retrieval instruction signal by validator transceiver 10, validation control device 8 may search and retrieve validation information stored in memory device 9 and transmit retrieved validation information to printer 3 through validator transceiver 10. Validation control device 8 may utilize as memory device 9 external RAMs connected thereto or internal RAMs integrally configured in validation control device 8. Validation control device 8 receives detection signals from inlet sensor 21 and featured signals of document from discrimination sensor device 6 to drive conveyor 5. When valuable document is inserted into validator 2, conveyor 5 conveys valuable document along passageway. Discrimination sensor device 6 comprises an optical sensor 24 such as a photo-coupler, image sensor or CCD camera for photo-electrically converting printed patterns on surfaces of valuable document into electric signals, and a magnetic sensor 25 such as a magnetic head or Hall element for magneto-electrically detecting and converting magnetic components printed on surfaces of valuable document into electric signals. Discrimination sensor device 6 detects and converts physical features of valuable document into electric signals to validation control device 8 that then validates authenticity of valuable document depending on electric signals received. Deciding valuable document as genuine, validation control device 8 continues to drive conveyor 5 to move the document along passageway and stack it into a stacker 7. Validation control device 8 comprises its installed validation information retrieval program, validation diagnostic program and validation information sort program.

Printer 3 comprises an entry sensor 31 for detecting a card 20 inserted into an entry in printer 3 to produce a detection signal, a card sensor device 30 for photo-electrically or magneto-electrically detecting information recorded on card 20, a transporter 11 for transporting card 20 along a pathway formed in printer 3, a printing device 13 for thermally printing or erasing information on card 20, a printing control device 15 having input terminals connected to card sensor device 30 and entry sensor 31 and output terminals connected to transporter 11 and printing device 13, and a printer transceiver 14 for sending and receiving signals to and from validator 2. Card sensor device 30 comprises a reader 12 for detecting printing information on card 20 moving along pathway, and a magnetic head 32 as a card information reader device for detecting magnetic information on card 20 moving along pathway. Printing device 13 comprises a printer head 35 for thermally writing information on card 20, an eraser head 36 for thermally erasing a print recorded on card 20, and magnetic head 37 for writing magnetic information on card 20. Magnetic head 32 detects a retrieval instruction signal magnetically recorded on card 20 to forward the signal to printing control device 15 that then transfers the retrieval instruction signal to validator transceiver 10 in validator 2 and validation control device 8 through printer transceiver 14 and interface 4. Retrieval instruction signal recorded on card 20 may be indicative of validation control instruction signals, validation diagnostic instruction signals, modified program information, game credit information, recording information, control number of the recording information or any combination thereof. Reader 12 in printer 3 may be an image sensor, photo-coupler or CCD camera for photo-electrically reading out information thermally recorded on card 20.

When card 20 is put in printer 3, transporter 11 conveys card 20 along pathway. At this time, magnetic sensor 32 reads out and converts magnetic information into electric signals to printing control device 15, and in this case, magnetic information is magnetically recorded on card 20 and may comprise validation control instruction signals, validation diagnostic instruction signals, modified program information, game credit information, recording information, control number of the recording information or any combination thereof. Also, reader 12 photo-electrically reads out information thermally recorded on card 20 to convert it into electric signals to printing control device 15 that then drives and controls operation of transporter 11 and printing device 13 depending on information read out by magnetic sensor 32 and reader 12. Printing control device 15 in printer 3 is connected to a control system in a gaming machine.

Figure 3:
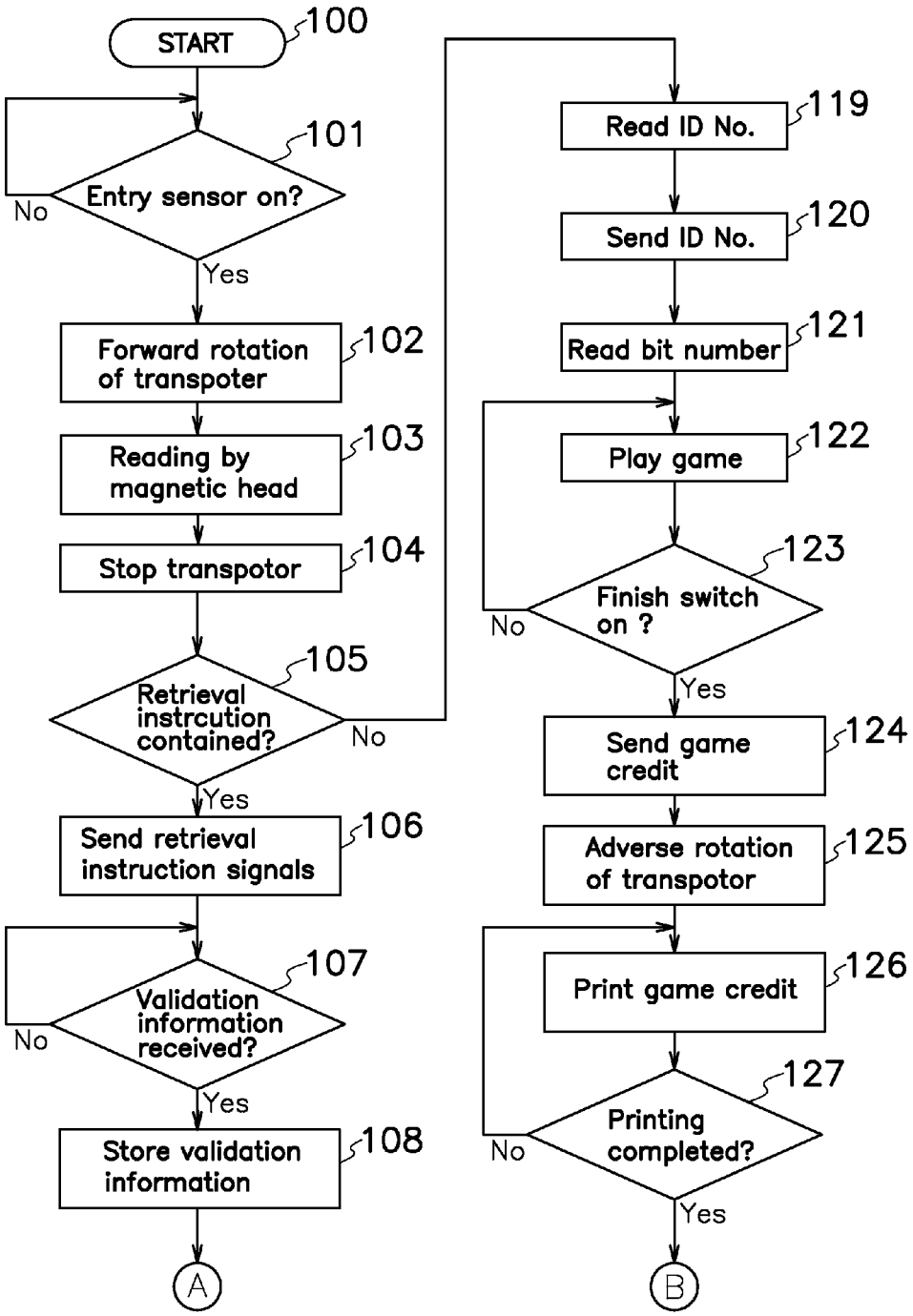
FIG. 3 A flow chart showing an anterior half of the operational sequence of a printer.
Figure 4:
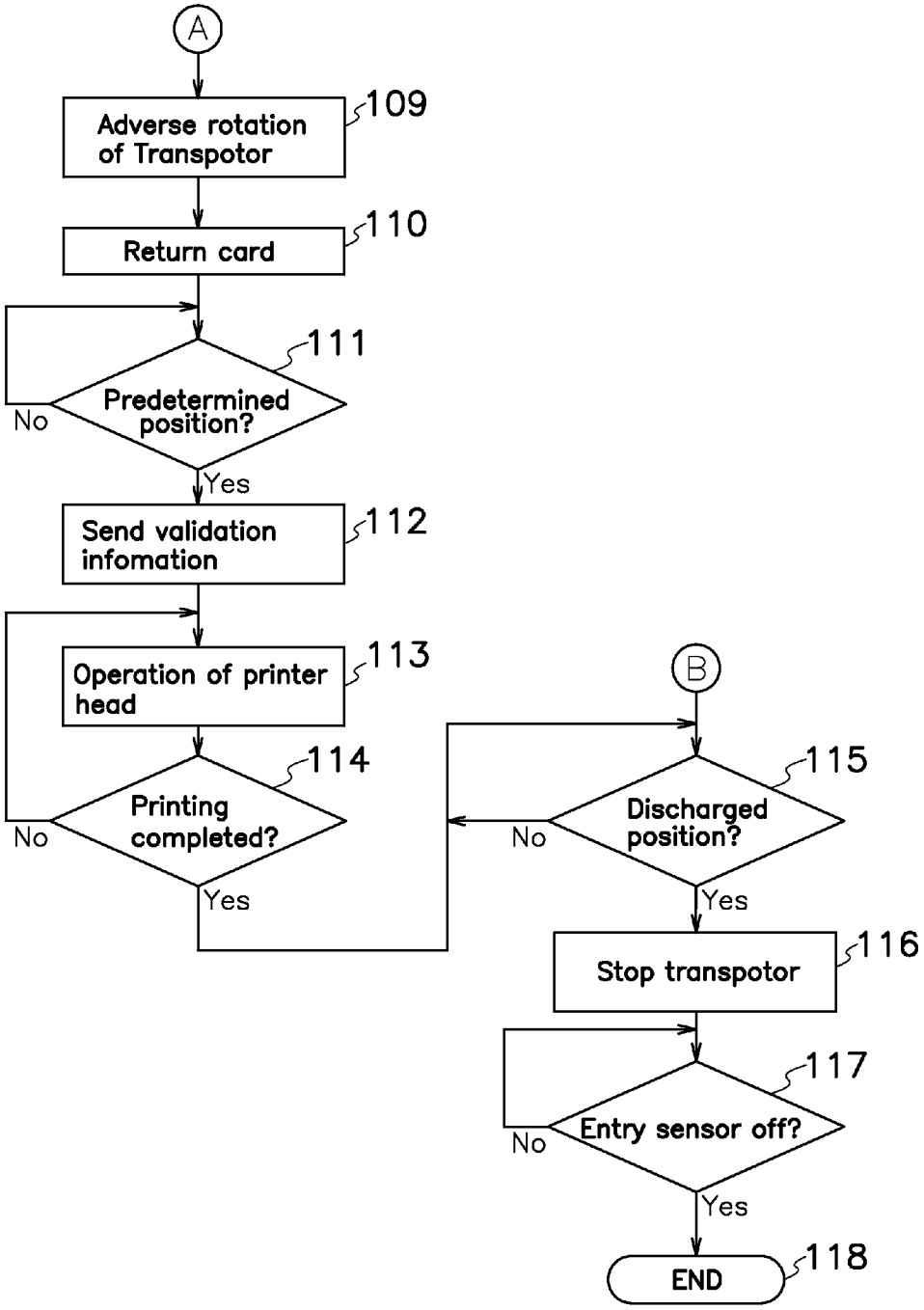
FIG. 4 A flow chart showing a posterior half of the operational sequence of the printer.

Printer 3 is operated in accordance with operational sequence shown in flow charts in FIGS. 3 and 4.

Processing moves on from Step 100 "START" to Step 101 where printing control device 15 decides on whether or not entry sensor 31 is turned on by insertion of card 20 into entry of printer 3. When entry sensor 31 is turned on by insertion of card 20, it produces a detection signal to printing control device 15 that therefore drives transporter 11 to carry card 20 inwardly of printer 3 (Step 102). Now, magnetic head 32 reads out information magnetically recorded on moving card 20 (Step 103), and then, printing control device 15 stops operation of transporter 11 (Step 104). In subsequent Step 105, printing control device 15 decides in view of detection signals from magnetic head 32 on whether or not information magnetically recorded on card 20 contains a retrieval instruction signal. If retrieval instruction signal is contained, printing control device 15 transmits retrieval instruction signal to validator transceiver 10 in validator 2 through printer transceiver 14 and interface 4 (Step 106).

After that, processing in program for printer 3 moves on to Step 107 where printing control device 15 decides on whether or not printer transceiver 14 receives validation information from validator 2 through interface 4. If it receives validation information in Step 107, printing control device 15 stores validation information in its own memory area (Step 108) and drives transporter 11 in the adverse direction (Step 109) to return card 20 toward a discharge position (Step 110). Printing control device 15 decides based on a detection signal from a perceivable sensor not shown in the drawings on whether or not card 20 is transported to a predetermined position along pathway (Step 111), and when this is affirmative, printing control device 15 lowers and brings printer head 35 into close contact to card 20. Then, in Step 112, printing control device 15 forwards validation information to printer head 35 and operates it to print validation information on card 20 (Step 113). Here, repeated motions are carried out to drive transporter 11 in the forward and adverse directions and stop it to properly print validation information on card 20 by printer head 35, however, even if transporter 11 intermittently runs, card 20 is finally sent toward the discharge position. In Step 114 followed, printing control device 15 decides on whether or not printer head 35 completes printing, and if unfinished, procedure returns to Step 113, adversely if finished, printing control device 15 moves printer head 35 to the upward position. Moreover, printing control device 15 decides by a detection signal from a perceivable sensor not shown on whether or not card 20 reaches discharge position (Step 115). When card 20 gets there, printing control device 15 stops operation of transporter 11 (Step 116) to retain card 20 in the outwardly-protruded condition at entry in printer 3. Then, an operator may pull out card 20 from entry to turn entry sensor 31 off (Step 117) to finish operation of printer 3 (Step 118).

When card 20 contains no retrieval instruction signal in Step 105, processing goes on to Step 119 where printing control device 15 picks out identification number recorded on card 20 of information read out by magnetic head 32 and sends identification number to gaming machine (Step 120). Then, gaming machine reads out bit number corresponding to the identification number (Step 121) to make the related gaming machine operational (Step 122). Then, gaming machine decides on whether or not a finish switch is turned on to terminate utilization of gaming machine (Step 111); if not turned on, processing is returned to Step 122; adversely if turned on, gaming machine transmits game credit of finished game to printer 3 in Step 124; printing control device 15 in printer 3 drives transporter 11 for the reverse rotation (Step 125); and printing control device 15 causes printer head 35 to print game credit on card 20 (Step 126). Printing control device 15 decides on whether or not printing is finished in Step 127, and if finished or not finished, procedure returns to respectively Step 115 or 126.

Next, operation of validator 2 will be described hereinafter with reference to flow charts shown in FIGS. 5 and 6.

Processing goes on from Step 200 "START" to 201 where validation control device 8 decides on whether or not validator transceiver 10 receives a retrieval instruction signal from printer transceiver 14 in printer 3. When validator transceiver 10 receives retrieval instruction signal, validation control device 8 searches, retrieves and reads out validation information stored in memory device 9 in validator 2 (Step 218). Then, validation control device 8 forwards validation information to printer transceiver 14 in printer 3 through validator transceiver 10 and interface 4 (Step 219) terminating operation (Step 220). After that, printer 3 carries out processes in Step 107 and subsequent Steps in FIG. 3.

Figure 5:
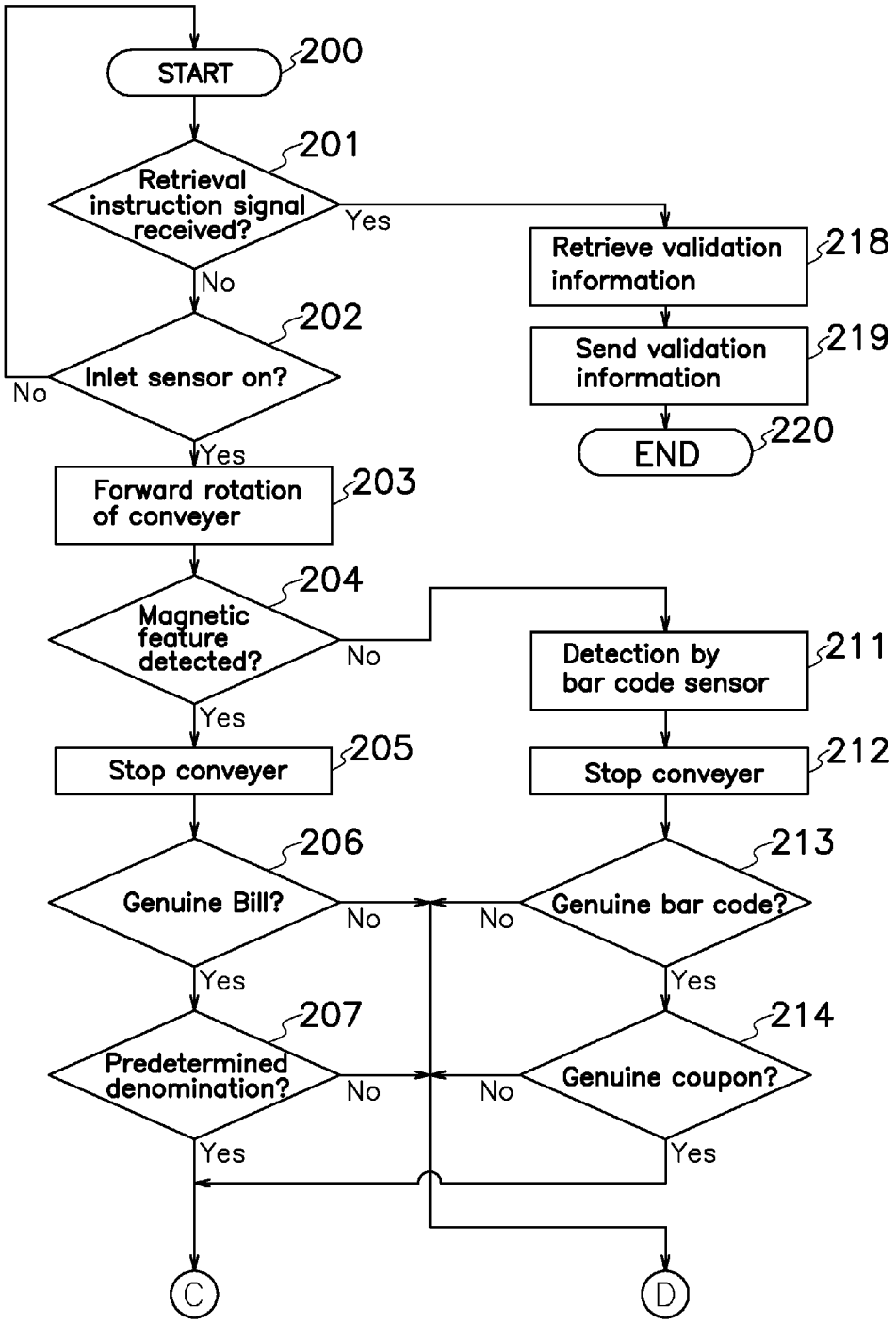
FIG. 5 A flow chart showing an anterior half of the operational sequence of a validator.
Figure 6:
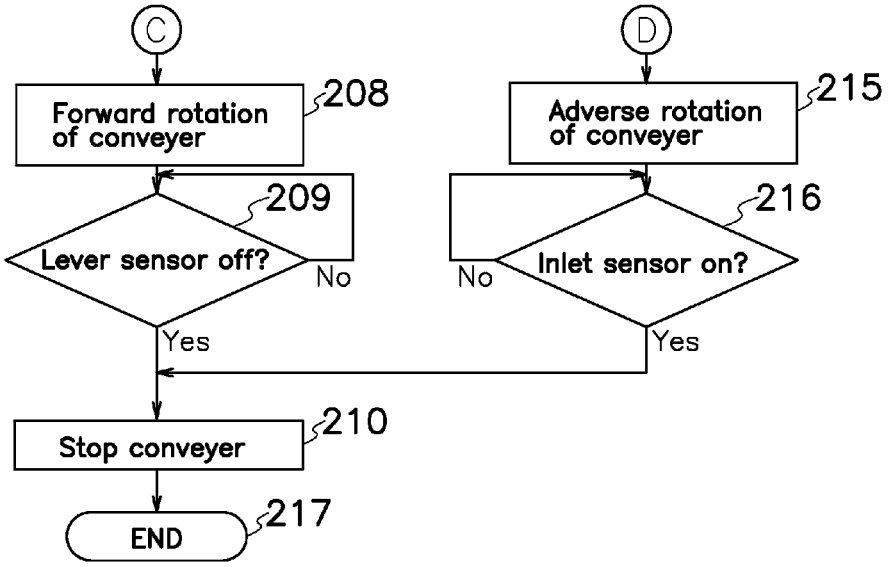
FIG. 6 A flow chart showing a posterior half of the operational sequence of the validator.
Figure 7:
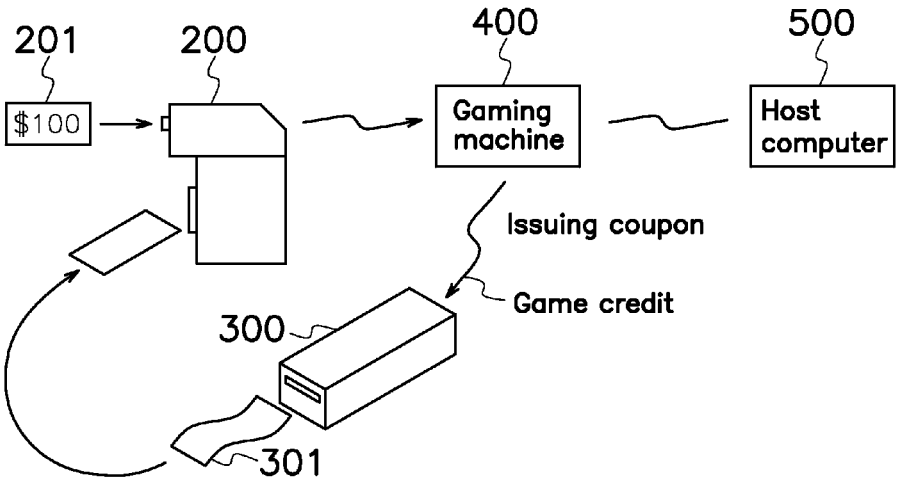
FIG. 7 A block diagram showing an example of prior art systems for handling valuable documents.
Figure 8:
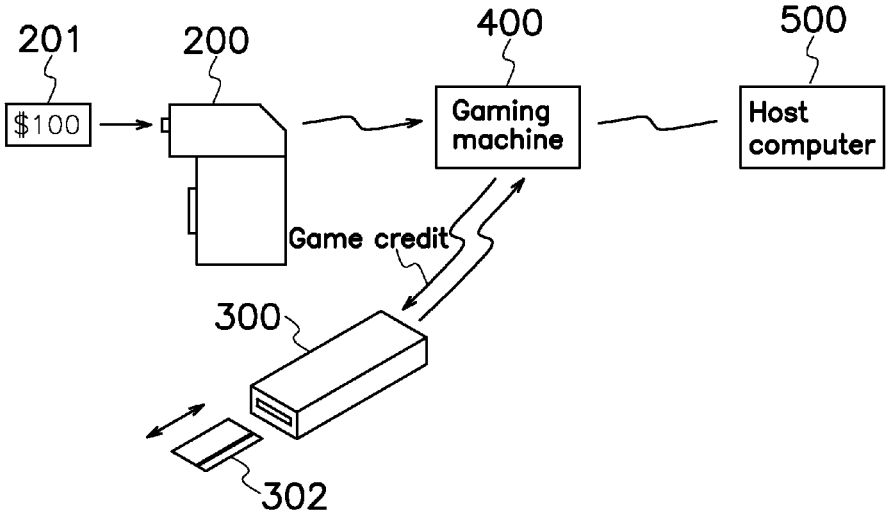
FIG. 8 A block diagram showing another example of prior art systems for handling valuable documents.

When validator transceiver 10 receives no retrieval instruction signal in Step 201 of FIG. 5, validation control device 8 starts behaviors in Step 202 and its subsequent Steps. Detailed behaviors of validator 2 are described in Japanese Patent No. 3,320,806 and the following indicates a brief explanation of behaviors by validator 2. In Step 202, validation control device 8 decides on whether or not inlet sensor 21 is turned on by insertion of bill or coupon ticket into inlet in validator 2. When inlet sensor 21 is turned on, validation control device 8 drives conveyor 5 for the forward rotation (Step 203) to carry document along passageway inwardly of validator 2. Optical sensor 24 in discrimination sensor device 6 converts printed patterns indicating physical features on document moving along passageway into electric signals to validation control device 8, and magnetic sensor 25 in discrimination sensor device 6 converts magnetic patterns on document into electric signals to validation control device 8. Specifically, optical sensor 24 converts optical features of transmitted or/and reflected lights from document into electric signals to validation control device 8. Magnetic sensor 25 converts ferrous component in ink printed on document into electric signals to validation control device 8. Bar code sensor 26 photo-electrically or magneto-electrically converts bar codes printed on document into electric signals to validation control device 8.

Validation control device 8 decides existence or absence of magnetic components based on received electric signals (Step 204), and when there are detected predetermined magnetic components in ink, validation control device 8 decides the inserted document as a bill to cause processing to go on to Step 205 where it stops operation of conveyor 5 to decide on whether the detected bill is genuine or not (Step 206). When the bill is considered genuine in Step 206, sequence moves on to Step 207 where validation control device 8 decides depending on received electric signals on whether or not the bill belongs to a denomination or kind of currency acceptable to validator 2. When it is acceptable, validator control device 8 transmits denomination signals to gaming machine, simultaneously drives conveyor 5 for the forward rotation in Step 208 and also decides on whether or not an off signal is created by a lever sensor not shown provided at an outlet of passageway (Step 209). When the lever sensor produces the off signal, processing goes on to Step 210 where validator 2 stops operation of conveyor 5 (Step 210) to finish the sequence (Step 217).

Unless validation control device 8 detects magnetic components in Step 204, processing moves on to Step 211 where validator control device 8 collects or samples electric signals from bar code sensor 26 to stop conveyor 5 (Step 212). Then, operation goes on to Step 213 where validation control device 8 decides in view of electric signals from bar code sensor 26 on whether or not bar code or coupon ticket is genuine. If this is true, then validation control device 8 decides in view of received signals from optical sensor 24 and/or magnetic sensor 25 other than bar code sensor 26 in a next Step 214 on whether or not coupon ticket indicates genuineness or a predetermined kind, and when this is affirmative, processing moves on to Step 208. When validation control device 8 does not decide document as a genuine bill in Step 206, when does not decide document as a predetermined denomination in Step 207, when does not decide bar code as genuine in Step 213 or when does not decide coupon as genuine in Step 213, processing moves on to Step 215 where validation control device 8 drives conveyor 5 for its adverse rotation to return document to inlet in validator 2, and when inlet sensor 21 is turned on (Step 216), process goes on to Step 210 where it stops conveyor 5 for termination of operation (Step 217).

EXAMPLE 1

Examples of the embodiments of the invention are described hereinafter to print on card 20 by printer 3 validation information stored in validator 2.

Validator 2 automatically transmits its stored validation information to printer 3 through interface 4 after a certain period of time. Otherwise, when a trigger switch not shown in the drawings is turned on to provide validator 2 with a transmission instruction signal of validation information or when validator 2 receives a retrieval instruction signal from printer 3, validator 2 may execute retrieval program of validation information; thereby it may search, retrieve and read out document information of at least one authenticated document from memory device 9 as validation information; if necessary, it may carry out validation information sort program to sort retrieved validation information; and it may transmit the validation information to printer 3 through interface 4. Then, printer 3 records the received validation information of valuable document on card 20.

EXAMPLE 2

Then, the following describes another example of previously magnetically recording on card 20 information to be read out and sent to validator 2 such as a validation control instruction signal, validation diagnostic instruction signal and/or modified program information.

When card 20 is inserted into printer 3, entry sensor 31 detects insertion of card 20 to produce a detection signal to printing control device 15 that then drives transporter 11 for its forward rotation to take card 20 in printer 3. At the moment, magnetic head 32 in printer 3 converts magnetic information recorded on card 20 into electric signals to printing control device 15 that detects validation control instruction signals contained in electric signals from magnetic head 32 and transmits validation control instruction signals to validator transceiver 10 in validator 2 through printer transceiver 14. Therefore, validator transceiver 10 forwards validation control instruction signals to validation control device 8 that runs validation information retrieval program to firstly read out document information on at least one authenticated document from memory device 9 as validation information; secondly if necessary, to run validation information sort program to sort retrieved validation information; and thirdly to transmit read validation information to printer transceiver 14 through validator transceiver 10. In this case, validation control device 8 may retrieve from memory device 9 validation information that may comprise document information of all valuable documents authenticated within a certain period of time depending on signals from discrimination sensor device 6 and times of and over authentication or code information denoting the gaming machine, and if necessary validation control device 8 may run validation information sort program to sort the read validation information, and transmit it to printer transceiver 14 through validator transceiver 10. Subsequently, printer transceiver 14 transmits document information to printing control device 15 that then drives printer 13 to record document information on card 20.

EXAMPLE 3

When card 20 is put in printer 3, entry sensor 31 detects entry of card 20 to produce a detection signal to printing control device 15 that drives transporter 11 for its forward rotation to transmit card 20 into printer 3. Then, magnetic head 32 in printer 3 converts magnetic information recorded on card 20 into electric signals to printing control device 15 that detects validation control instruction signals contained in received electric signals and delivers them to validator transceiver 10 in validator 2 through printer transceiver 14. There, validator transceiver 10 sends validation control instruction signals to validation control device 8 that then selects address numbers for designating specific memory areas storing the required information, accesses the specific memory areas related to the address numbers, and retrieves validation information from the memory areas. So, validation control device 8 transmits the fetched validation information to printer transceiver 14 through validator transceiver 10 and interface 4. Then, printer transceiver 14 transmits document information to printing control device 15 that then drives printing device 13 to record document information on valuable documents on card 20.

EXAMPLE 4

Magnetic head 32 in printer 3 converts magnetic information recorded on card 20 into electric signals to printing control device 15 that then detects validation diagnostic instruction signals in received electric signals and transmits them to validator transceiver 10 in validator 2 through printer transceiver 14. There, validation control device 8 executes validation diagnostic program to collect diagnostic information at each location in validator 2 based on validation diagnostic instruction signals and also to send diagnostic information to printer transceiver 14 through validator transceiver 10. In this case, in accordance with a self-diagnostic program, validation control device 8 diagnoses the condition of each location in validator 2 to collect each diagnostic information, and if necessary runs diagnostic information sort program to sort the fetched diagnostic information. After that, printer transceiver 14 sends diagnostic information to printing control device 15 that then drives printing device 13 to record diagnostic information of validator 2 on card 20.

EXAMPLE 5

In Example 4, diagnostic information may comprise information regarding a report of light receiving level at optical sensors such as inlet sensor 21 in validator 2, discrimination sensor device 6, and passage detection sensors and fluctuant degree in rotative rate or acceleration in conveyor motor or drive motor provided in validator 2. For instance, validation control device 8 may decide malfunction or breakdown when each of the motors indicates fluctuation over plus or minus 2% in rotation rate, while decides as a normal operation with fluctuation in rotation rate within plus or minus 2%.

EXAMPLE 6

Magnetic head 32 in printer 3 converts magnetic information recorded on card 20 into electric signals to printing control device 15 that then detects, receives and transmits modified program information contained in electric signals to validator transceiver 10 in validator 2 through printer transceiver 14. Validator transceiver 10 transmits modified program information to validation control device 8 that then causes memory device 9 to store modified program information in place of existent program information stored in memory device 9 for renewal of program information. Printer transceiver 14 transmits program change information to printing control device 15 that then drives printing device 13 to record program change information of validator 2 on card 20 while operating validator 2 in accordance with modified program since then.

As above-mentioned, the system 1 for handling valuable documents according to the present invention may cause printer 3 to transmit retrieval instruction information to validation control device 8 through validator transceiver 10 in validator 2 so that validation control device 8 may retrieve validation information in validator 2 to further pass validation information to printer transceiver 14 in printer 3 through validator transceiver 10. When printer transceiver 14 receives validation information from printer 3, printing control device 15 drives printing device 13 to print validation information on card 20. Printing device 13 in printer 3 may serve to print information on card 20 or erase information printed on card 20, and printing control device 15 may control operations of printing device 13 and printer transceiver 14 in accordance with information read out from card 20. The system for handling valuable documents may incorporate validator and printer connected to each other for mutual communication to print, on a card by printer, validation information stored in validator or diagnostic information on each location in validator for visual confirmation on validation or diagnostic information. Also, a card may be inserted into printer to record information on card to update or change operational program in validator and to visually confirm changed information of operational program.

EXAMPLE 7

In Example 6, card 20 may be magnetically recorded data of denomination to be newly accepted or rejected by validator 2 so that magnetic head 32 converts the magnetic information on such new denomination into electric signals to printing control device 15. Thereby, validation control device 8 may cause memory device 9 to store and renew new denomination data in lieu of existent denomination data retained in memory device 9. Printer transceiver 14 transmits changed notice of denomination data to printing control device 15 that then drives printing device 13 to record on a card changed notice of denomination data in validator 2 to thereafter drive validator 2 in accordance with the updated denomination data.

The foregoing embodiments of the present invention may be modified and altered in various ways. By way of example, instead of utilizing magnetic head 32 as a reader for reading out information on a card, an optical sensor may be used to photo-electrically pick out information on card 20, reader 12 may be also used as a card information reader for photo-electrically reading out information recorded on card 20.

INDUSTRIAL APPLICABILITY

The present invention is applicable to all and any system for handling valuable documents and recording information on a card or token card used in bill-operated facilities.

EXPLANATION OF SYMBOLS (1) . . . A system for handling valuable documents, (2) . . . A validator, (3) . . . A printer, (4) . . . An interface, (5) . . . A conveyor, (6) . . . A discrimination sensor device, (7) . . . A stacker, (8) . . . A validation control device, (9) . . . A memory device, (10) . . . A validator transceiver, (11) . . . A transporter, (12) . . . A reader, (13) . . . A printing device, (14) . . . A printer transceiver, (15) . . . A printing control device, (20) . . . A card, (21) . . . An inlet sensor, (24) . . . An optical sensor, (25) . . . A magnetic sensor, (26) . . . A bar code sensor, (32) . . . A magnetic head (A card information reader), (35) . . . A printer head, (36) . . . An eraser head,

The invention claimed is:

1. A system for handling valuable documents comprising:

a validator for validating authenticity of valuable documents, a printer for recording information on a card, an interface for intercommunicating the validator and printer, and a gaming machine connected to the validator and printer, wherein the validator comprises a validation control device for processing validation information of the valuable documents, a memory device connected to the validation control device that writes or stores the validation information in the memory device and searches the validation information in the memory device, and a validator transceiver connected to the validation control device for mutual communication, the printer comprises a printing control device, a transporter connected to the printing control device for transporting the card along a pathway, a printing device connected to the printing control device for recording information on the card, a printer transceiver connected to the printing control device for mutual communication, and a card information reader device or reader for detecting a retrieval instruction signal recorded on the card and forwarding the retrieval instruction signal to the printing control device that then transmits the retrieval instruction signal to the validation control device through the printer transceiver, interface and validator transceiver, the validation control device receives the retrieval instruction signal from the printing control device, searches the validation information stored in the memory device and forwards the retrieved validation information to the printing control device through the validator transceiver, interface and printer transceiver, the printing control device operates the printing device to record on the card the validation information received from the validation control device, and when the card does not contain the retrieval instruction signal, the printing control device picks out an identification number that is detected from the card by the card information reader device or reader, and sends the identification number to make the gaming machine operational, whereby the card with the retrieval instruction can be used to obtain the validation information, the card without the retrieval instruction can be used to make the gaming machine operational, and the gaming machine can be used for gaming when it is operational and has received validated authentic valuable documents.

2. The system of claim 1, wherein the validator transmits its stored validation information automatically to the printer through the interface.

3. The system of claim 1, wherein the validator further comprises a trigger switch that is turned on to provide the validator with a transmission instruction signal of the validation information, with the transmission instruction received, the validator reads out the document information of at least one authenticated document from the memory device as the validation information and transmits the validation information to the printer through the interface.

4. The system of claim 1, wherein the printing device prints information on the card or erases information printed on the card, and the printing control device controls operations of the printing device and printer transceiver in accordance with information read out from the card.

5. The system of claim 1, wherein the validation control device comprises validation information retrieval program, with the retrieval instruction signal received, the validation control device executes the validation information retrieval program to search and retrieve specific validation information stored in the validator and transmits the retrieved specific validation information to the printer through the validator transceiver.

6. The system of claim 5, wherein the specific validation information comprises document information inclusive of money amount of the document or documents finally decided as genuine by the validator and stored in the stacker, the validation control device retrieves the document information as the specific validation information and forwards the retrieved validation information to the printer through the validator transceiver.

7. The system of claim 1, wherein the reader reads out and forward a validation control instruction signal recorded on the card to the printing control device, the printing control device receives and forwards the validation control instruction signal to the validation control device in the validator through the printer transceiver, interface and validator transceiver, in accordance with the validation control instruction signal received, the validation control device reads out the validation information on at least one valuable document from the memory device and sends the validation information to the printing control device through the validator transceiver, interface and printer transceiver, and the printing control device operates the printing device to record the validation information of the valuable document on the card.

8. The system of claim 1, wherein the validation control device comprises validation information retrieval program, with the retrieval instruction signal received, the validation control device carries out the validation information retrieval program to read out the validation information on at least one valuable document stored in the memory device and sends the validation information to the printer through the validator transceiver.

9. The system of claim 1, wherein the reader reads out and forwards a validation diagnostic instruction signal recorded on the card to the printing control device, the printing control device receives and forwards the validation diagnostic instruction signal to the validator transceiver in the validator through the printer transceiver, the validator transceiver forwards the validation diagnostic instruction signal to the validation control device, the validation control device collects diagnostic information at each location in the validator as validation information in accordance with the validation diagnostic instruction signals and forwards the validation information to the printer transceiver through the validator transceiver, the printer transceiver forwards the validation information to the printing control device, and the printing control device operates the printing device to record the validation information of the validator on the card.

10. The system of claim 1, wherein the reader reads out and forwards modified program information recorded on the card to the printing control device, the printing control device receives and forwards the modified program information to the validator transceiver in the validator through the printer transceiver, the validator transceiver transmits the modified program information to the validation control device that then updates program in the memory device by storing the modified program information in the memory device in place of existent program information stored in the memory device, the printer transceiver sends the program renewal information to the printing control device that then operates the printing device to record the program renewal information in the validator, and the validator is operated in accordance with the renewed program.

11. The system of claim 1, wherein the gaming machine reads out bit number corresponding to the identification number to make the gaming machine operational, after the printing control device sends the identification number to the gaming machine.

* * * * *